United States Patent [19]

Good et al.

[11] 3,962,820

[45] June 15, 1976

[54] CONNECTION FOR MINIATURE TOY VEHICLE PARTS

[75] Inventors: Thomas W. Good, Minnetonka; Bernard J. Dehner, Mound, both of Minn.

[73] Assignee: Tonka Corporation, Hopkins, Minn.

[22] Filed: Jan. 6, 1975

[21] Appl. No.: 538,679

[52] U.S. Cl. ..... 46/221

[51] Int. Cl.[2] ..... A63H 17/26

[58] Field of Search ..... 46/221, 222, 223, 201, 46/16, 17

[56] References Cited

UNITED STATES PATENTS

| | | | |
|---|---|---|---|
| 2,383,441 | 8/1945 | Beile | 46/222 |
| 3,107,453 | 10/1963 | Balthazor | 46/221 |
| 3,553,887 | 1/1971 | Linstead | 46/223 |
| 3,721,042 | 3/1973 | Marason, Jr. | 46/223 |

*Primary Examiner*—Louis G. Mancene
*Assistant Examiner*—Jack Q. Lever
*Attorney, Agent, or Firm*—Douglas L. Carlsen

[57] ABSTRACT

A connection for use in connecting a rigid sheet material part in a toy vehicle with a relatively more resilient part wherein the rigid part is provided with a round aperture and the resilient part has an expansion collar thereon which is somewhat greater in diameter than the aperture but which can be forced therethrough in a contracted condition, and a third member which is inserted axially into the collar to retain it in an expanded condition to prohibit its removal from the aperture.

3 Claims, 5 Drawing Figures

FIG. 1
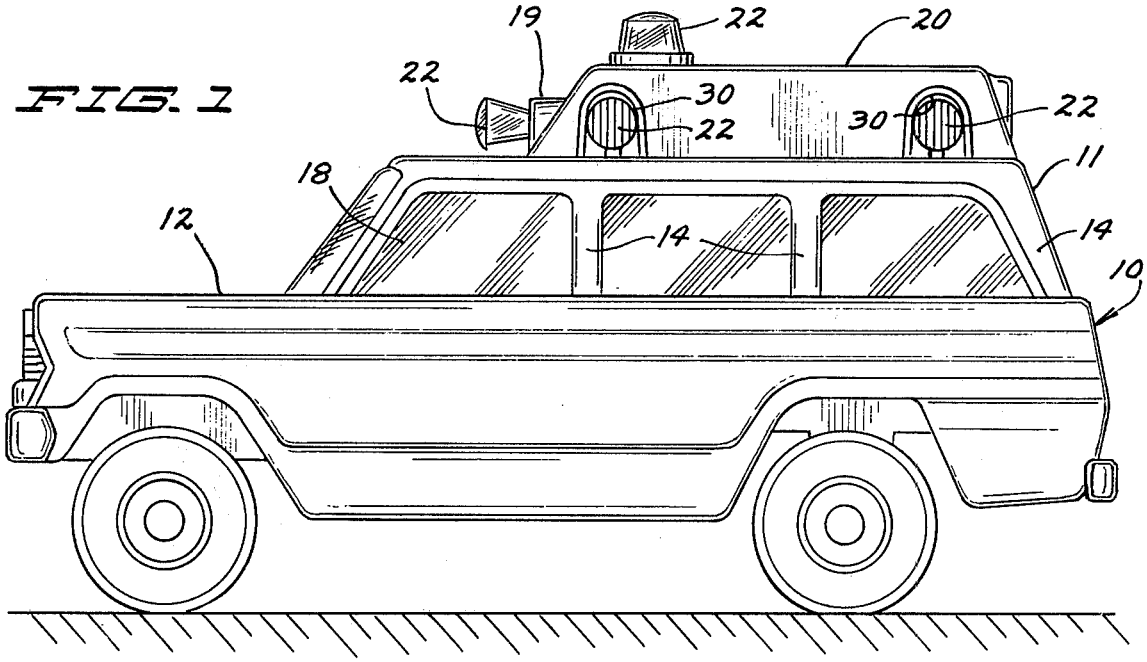
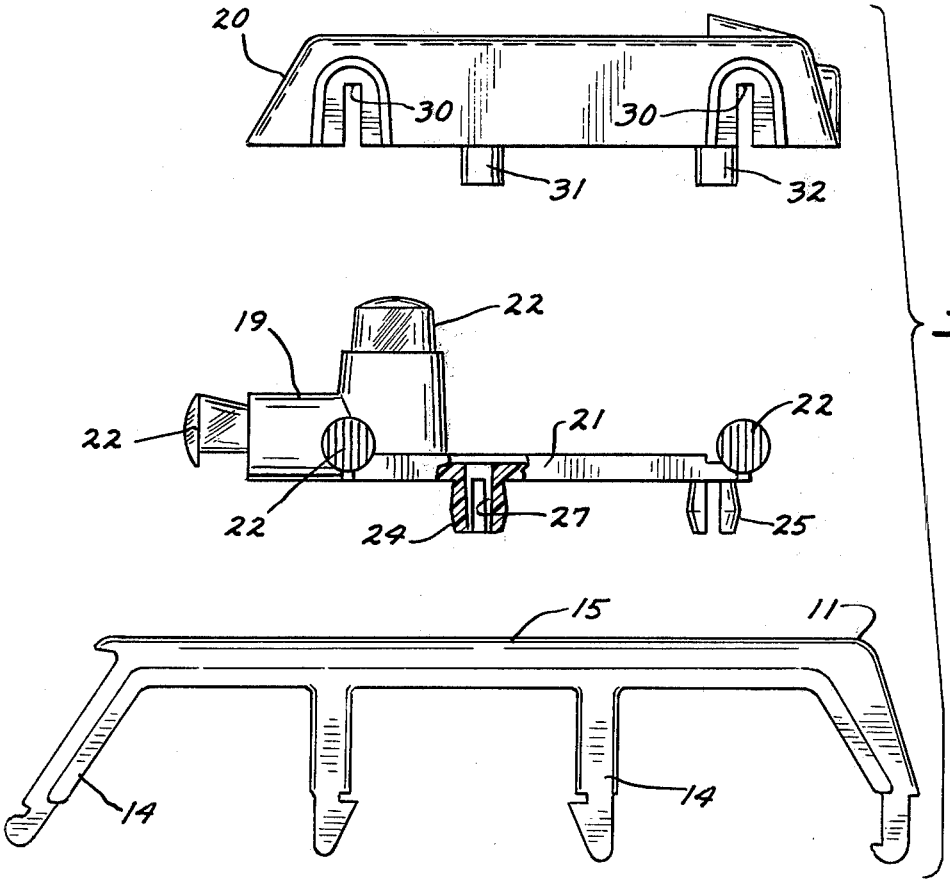
FIG. 2

FIG. 3
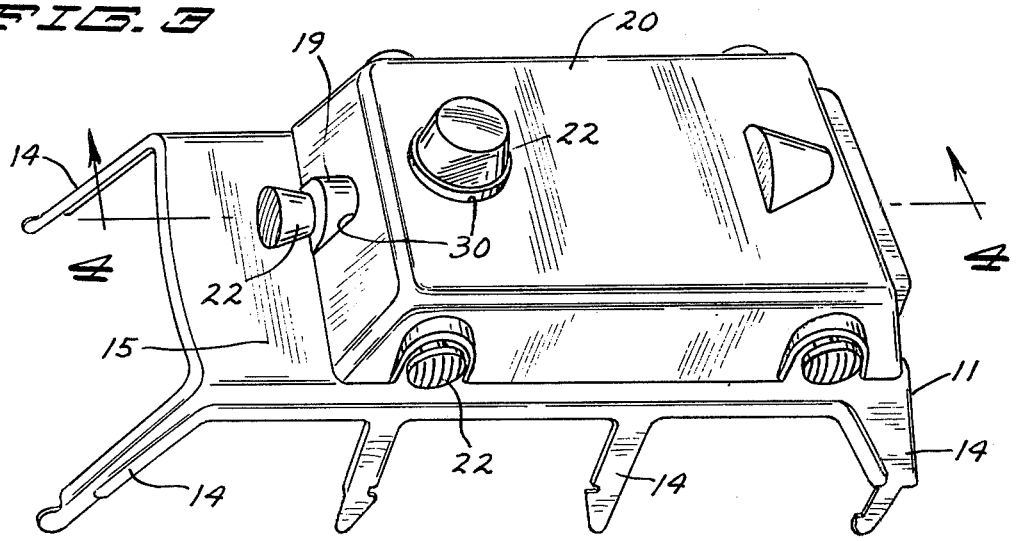
FIG. 4
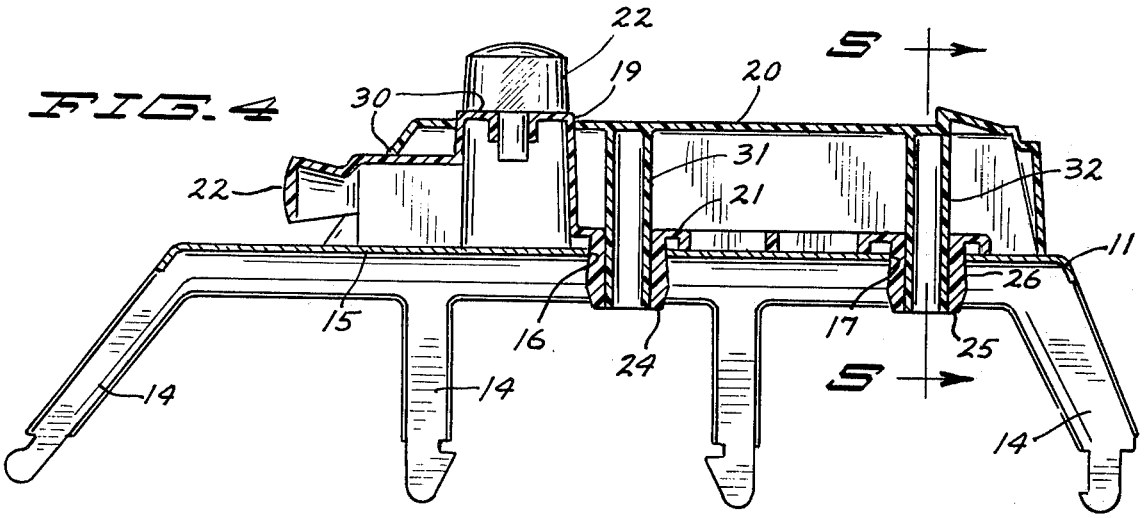
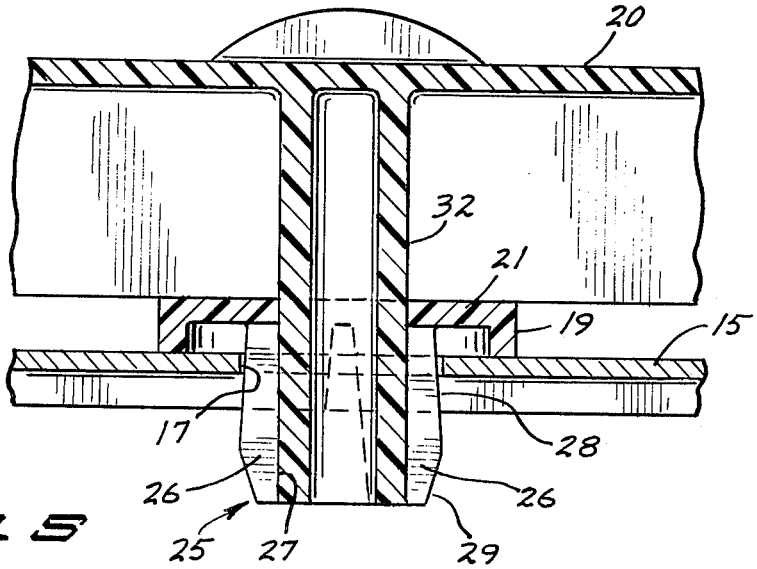
FIG. 5

CONNECTION FOR MINIATURE TOY VEHICLE PARTS

The manufacturers of miniature toy vehicles, of the type generally played with by children in the very low age bracket, are constantly looking for features and methods of construction which more effectively secure the vehicle parts together for safety of the child and extended use of the toy without materially increasing the cost of manufacture.

While forming the toy vehicle bodies completely of sheet metal is perhaps the most desirable from a durability standpoint, the inclusion of certain easily molded plastic components can enhance the realistic appearance of the vehicle. Normally resilient plastic parts are connected to the metal or other more rigid plastic parts by some flange means which permits ready disassembly or by a fastener such as a rivet which adds to the cost of manufacture.

The primary object of the present invention is to provide a new and improved construction for interconnecting miniature toy vehicle parts which is secure, relatively inexpensive to manufacture, and easy to assemble.

With this and other objects in view the invention broadly comprises providing a relatively rigid sheet material part with a round aperture, and another part of relatively resilient plastic material with an expansion collar having annularly arranged segments adapted to be contracted to allow the collar to be forced through the aperture and then expand again to a normal condition larger than the aperture, and rigid post or peg member inserted into the collar while it is in such expanded condition to prohibit such contraction again so that the collar may not be withdrawn through the aperture.

BRIEF DESCRIPTION OF THE DRAWINGS

In the drawings:

FIG. 1 is a side elevation of a miniature toy safety vehicle with simulated siren and light attachments mounted on the vehicle roof by means of the expansion connector forming the subject of this invention.

FIG. 2 is an exploded view of the roof components shown in FIG. 1 prior to assembly.

FIG. 3 is a top front perspective view of the roof.

FIG. 4 is a longitudinal vertical section through the roof taken on line 4—4 of FIG. 3.

FIG. 5 is a vertical section through one of the expansion connectors taken on line 5—5 of FIG. 4.

DESCRIPTION OF THE PREFERRED EMBODIMENT

Referring now more particularly to the drawings reference numerals will be used to denote like parts or structural features in the different views. The numeral 10 denotes generally a basic wagon-type vehicle having a roof 11 mounted upon the wheeled body 12 by means of various side and corner posts 14. The roof has a top 15 formed of rigid material such as sheet metal and which has a pair of round apertures 16 and 17 (FIG. 4) formed in longitudinally spaced positions along the longitudinal center line of the roof. A bubble insert 18 is preferably provided within the roof 11 and locked between the roof and body 12 to form transparent windows all around the vehicle.

The roof attachment simulating lights, siren, loudspeaker or the like are here made up of inner and outer components designated generally at 19 and 20. The inner or in this case lower component 19 is formed of resilient molded plastic and has a relatively flat base portion 21 adapted to lie flush against the roof top 15. Various light or siren simulating appendages 22 extend outwardly from base portion 21. On the underside of base 21 the component has a pair of depending expansion collars 24 and 25 of identical design. Each collar has two or more arcuate segments 26 arranged annularly and spaced slightly apart at their adjacent edges to allow them to be relatively contracted toward the axis of the collar. The segments are preferably formed so as to have their inner surfaces 27 angle slightly toward the center axis in their downward extension. The outer surface of each segment 26 angles outwardly as at 28 and then inwardly as at 29 in its downward extension. The axes of expansion collars 24 and 25 are spaced apart the same distance as the axes of apertures 16 and 17 in the top 15. The external diameter of the collar 25 at its ends is slightly less and its broadest diameter at the juncture between surfaces 28 and 29 is slightly greater than the diameter of aperture 17. The same is, of course, true between collar 24 and aperture 16.

Turning now to the outer or upper component 20 it will be observed that aesthetically it serves as a cover for the component 21 to smoothly finish off the top of the vehicle. This component formed of relatively hard plastic material has a generally inverted tray shape with various openings 30 therein for allowing the various appendages 22 on the inner component 19 to project therethrough. A pair of posts denoted respectively at 31 and 32 extend downwardly in longitudinally spaced relation within the peripheral walls of member 19 and substantially therebelow. These posts are circular in cross section and have their axes spaced apart the same distance as the axes of expansion collars 24 and 25 and apertures 16 and 17. The external diameter of the posts is constant throughout their length and is equal to the internal diameter of the expansion collars at their upper ends to fit snugly therein.

In assembly the basic vehicle is first assembled with the prepainted metal roof 11 and body 12 parts being locked to each other as by the hooks in posts 14. The inner attachment component 19 is then lowered from its premounted position shown in FIG. 2 onto the top 15 of the roof with the resilient expansion collars forced through the openings 16 and 17 and expanding after they have passed completely through the openings and the base 21 is in flush contact with the roof top panel 15. The outer attachment component 20 is then lowered over component 19 with the posts 31 and 32 penetrating and having a tight friction fit respectively within the collars 24 and 25 so that the components are in the condition shown in FIG. 4.

Inasmuch as the interior walls of the expansion collars converge lightly in their downward extension in their unstressed condition, the collars 24 and 25 will be expanded as the posts 31 and 32 are inserted thereinto whereby the exterior dimension of the collars will be greater than that of apertures 16 and 17 to prohibit their upward withdrawal therethrough. Accordingly members 19 and 20 become permanently locked to the roof 11.

While upward endwise pressure on posts 31 and 32 could possibly force them out of the expansion collars, it will be understood that this will not realistically take place due to the enclosure provided by the bubble 18 and the lower body components.

This construction has unlimited applications in the miniature toy vehicle construction field. It could in fact be used in most instances where it is desirable to interconnect a component of rigid sheet material such as the roof 11 with a relatively resilient component such as the member 19.

The construction provides a secure connection between parts made of different materials such as to prohibit disassembly by young children and allows swift assembly during the manufacturing of the toy.

Having now therefore fully illustrated and described the invention, what we claim to be new and desire to protect by United States Letters Patent is:

1. A connection for miniature toy vehicle parts comprising, a. a first toy vehicle component of rigid sheet material having an aperture therein, b. a second toy vehicle component of molded resilient plastic material, c. said second component having an expansion collar molded integrally therewith and extending outwardly therefrom formed of two or more arcuate segments arranged in spaced relation about a center axis, d. said expansion collar having a greater external diameter than said aperture but the segments being relatively contractible to allow the collar to be forced through the aperture and then return to its normal condition, and e. a third toy vehicle component including a post inserted axially into the collar to prohibit contraction of the segments.

2. The subject matter of claim 1 wherein said aperture is round and each of said segments has an inner surface angling slightly toward the center axis of the collar and an outer surface angling outwardly then inwardly relative to said axis in the extension of segment away from the second toy vehicle component.

3. The subject matter of claim 1 wherein said first toy vehicle component is the roof of a toy vehicle and there are two of said apertures spaced along the top thereof, said second toy vehicle component disposed on top of the roof and having two of said expansion collars spaced equally to said apertures and respectively extending therethrough and the third toy vehicle component having two posts spaced for insertion one into each of said collars.

* * * * *